US008770411B2

(12) United States Patent
Winkhardt et al.

(10) Patent No.: US 8,770,411 B2
(45) Date of Patent: Jul. 8, 2014

(54) METHOD AND DEVICE FOR THE SEPARATION OF FINE PARTICLES FROM GRANULATE-TYPE BULK MATERIALS IN A PIPELINE

(75) Inventors: Guido Winkhardt, Aulendorf (DE); Michael Heep, Weingarten (DE)

(73) Assignee: Zeppelin Systems GmbH, Friedrichshafen (DE)

( * ) Notice: Subject to any disclaimer, the term of this patent is extended or adjusted under 35 U.S.C. 154(b) by 71 days.

(21) Appl. No.: 13/309,059

(22) Filed: Dec. 1, 2011

(65) Prior Publication Data

US 2012/0168356 A1 Jul. 5, 2012

(30) Foreign Application Priority Data

Dec. 17, 2010 (DE) ..... 10 2010 054 849

(51) Int. Cl.
*B07B 4/00* (2006.01)

(52) U.S. Cl.
USPC ..... 209/138; 209/139.1; 209/142

(58) Field of Classification Search
USPC ..... 209/136, 137, 142, 143, 644, 138, 209/139.1
See application file for complete search history.

(56) References Cited

U.S. PATENT DOCUMENTS

| | | | | |
|---|---|---|---|---|
| 5,152,604 | A * | 10/1992 | Paul | 366/101 |
| 5,351,832 | A * | 10/1994 | Abbott et al. | 209/139.1 |
| 5,366,094 | A * | 11/1994 | Stein | 209/138 |
| 6,032,803 | A * | 3/2000 | Nicole et al. | 209/139.1 |
| 6,206,202 | B1 * | 3/2001 | Galk et al. | 209/715 |
| 6,712,216 | B2 * | 3/2004 | Van Oirschot | 209/138 |
| 8,245,963 | B2 * | 8/2012 | Devroe et al. | 241/79.1 |
| 8,281,931 | B2 * | 10/2012 | Drewes et al. | 209/154 |
| 8,312,994 | B2 * | 11/2012 | Schneider et al. | 209/139.1 |
| 2003/0085158 | A1 * | 5/2003 | Oirschot | 209/139.1 |
| 2010/0163464 | A1 * | 7/2010 | Fryars | 209/138 |
| 2011/0000827 | A1 * | 1/2011 | Minami | 209/139.1 |

FOREIGN PATENT DOCUMENTS

| | | | |
|---|---|---|---|
| DE | 353 481 | C | 5/1922 |
| DE | 19 24 037 | A1 | 11/1972 |
| DE | 33 27 461 | A1 | 2/1985 |
| DE | 234 807 | | 4/1986 |
| DE | 37 17 569 | C1 | 7/1988 |
| DE | 41 13 285 | | 10/1992 |

OTHER PUBLICATIONS

Search Report dated Dec. 12, 2011 in corresponding German Application No. 10 2010 054 849.9.
European Search Report dated Mar. 30, 2012 in corresponding European Application No. 11 00 9561.

* cited by examiner

*Primary Examiner* — David H Bollinger
(74) *Attorney, Agent, or Firm* — Faegre Baker Daniels LLP

(57) ABSTRACT

A method for the separation of fine particles from granulate-like bulk material conveyed in a pipeline as a product flow by means of a compressed air or vacuum conveyance, characterized in that the product flow is radially dispersed at the intake end of a pipe screen integrated in the pipeline in an airtight manner, and aerated there by a cleansing airflow, flowing at an angle to the direction of the dispersed product flow, in the region of a cleansing plane, which deflects the lighter particles, fibers, clusters, dust or similar items carried in the product flow from the trajectory of the heavier granulate, and conveys said into an annular sheath through which the cleansing air flows, from which they are removed by means of a separator.

21 Claims, 7 Drawing Sheets

Figure 1:
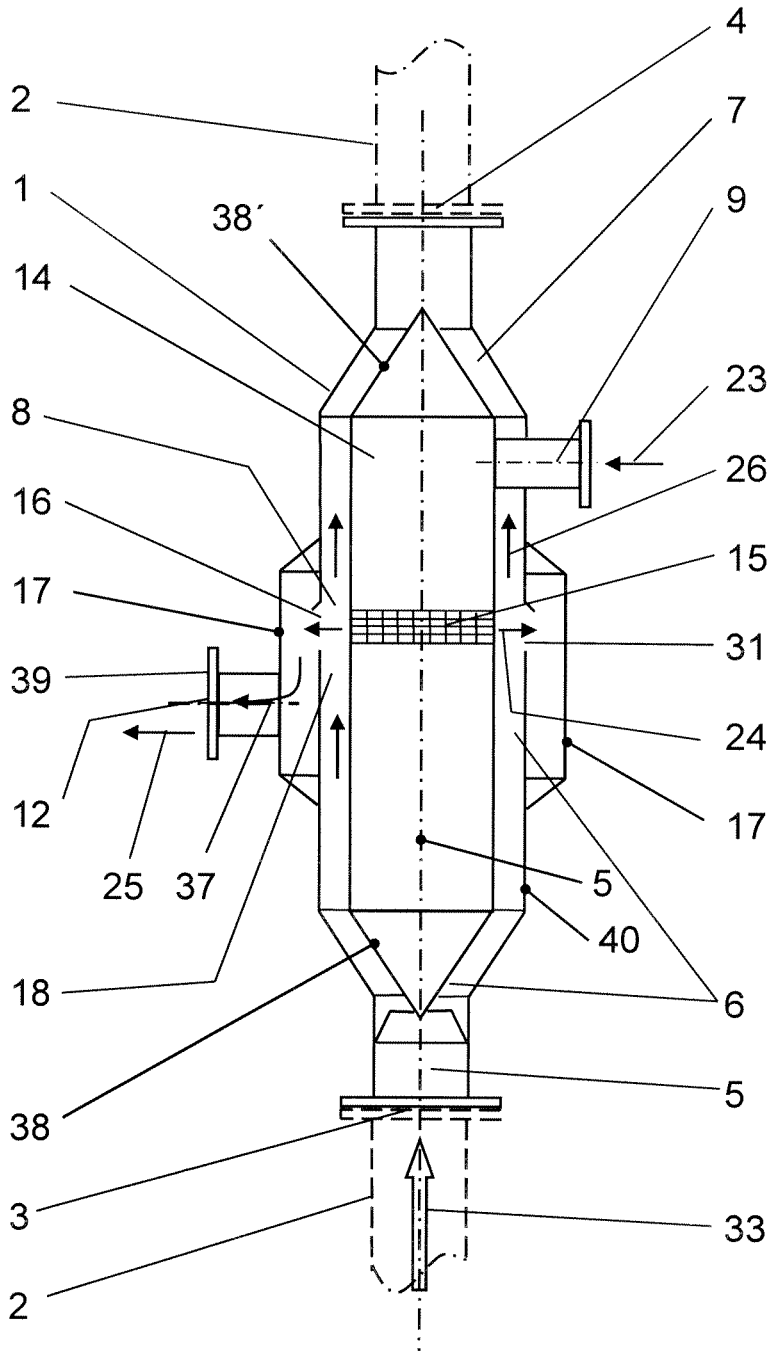

METHOD AND DEVICE FOR THE SEPARATION OF FINE PARTICLES FROM GRANULATE-TYPE BULK MATERIALS IN A PIPELINE

The subject matter of the invention is a method and a device for separating the fine elements (particles, fibers, clusters or dust) from granulate-type bulk materials conveyed in a pipeline.

In a plant facility for granulate-type bulk materials (synthetic granulates, food products, etc.) fine elements may be generated at different locations. The points of origin for fine elements are, for example:

a) during and directly following the production process (e.g. after the extruder for synthetic granulates)

b) during pneumatic or mechanical further transport c) in mixing and storage d) during loading and unloading of granulate-type bulk materials.

With these processes, the granulate-type bulk material is subjected to mechanical or thermal effects. In doing so, smaller particles, for example, may be released from granulate-type bulk materials. These fine particles lie either loosely among the granulate-type bulk materials, or adhere directly to the granulate-type bulk material due to mechanical forces (e.g. catching) or electrostatic forces. Quite frequently, these mixtures of granulate-type bulk materials with fine elements are undesired. A higher portion of fine elements requires a more extensive separation process (filtering) or causes defects, for example, in a subsequent process (extrusion from foils). Fine elements are also frequently the cause of a quicker aging process (e.g. with food products).

There are different separation principles for the separation of fine elements from granulate-type bulk materials.

Examples are mechanical, pneumatic, hydraulic, electrostatic, thermal, chemical, biological and optical cleansing processes. In the field of mechanical cleansing processes, the sieve represents a simple separation of course and fine materials. Pneumatic cleansing processes are, for example, air sifting (separation of wheat grain and husk) and counter-flow sifting.

For the cleansing of granulate-type bulk materials directly in the pneumatic feed pipe, no solution has yet been produced that has become established as common practice in plant facilities.

A conveyor of granulate-type bulk material in a pipeline wherein a separation device is also implemented has, in fact, been disclosed through the subject matter of DE 10 2008 045 613 A1. The disadvantage with this configuration however, is that instead of the fine elements being separated from coarse elements, the feedstock, containing both the portion of particles to be separated out and other materials, as well as the granulate, are taken as a whole and subjected to a separation. After the separation has been carried out, the cleansed material must be reintroduced to the pipeline. In this case, the characteristic is missing in which a pipeline screen can be incorporated directly in the conveyor pipeline for the feedstock. This is not possible in this case. The disadvantage, therefore, of this configuration is that a relatively large space is required, as the discharge of the feedstock and the subsequent separation of particles and fibers must take place in the plant, and subsequently the feed flow cleansed in this fashion must be returned to the flow.

With the subject matter of DE 10 2007 047 119 A1, another compressed air conveyor system for bulk material is disclosed, with which a granulate separator receives the feedstock by means of a vacuum conveyor. The coarse material is retained by means of a sieve, and the fine material to be removed is vacuumed off. This relates essentially to a vacuum cleaner principle, which is not, however, applicable for an air feed of granular materials in pipelines. Because of this, there is a larger procedural expenditure with the implementation of a separator of this type.

The subject matter of DE 41 13 285 A1 relates to a filter separator with which it is not possible to integrate the screen or separator as an integral component of a pipeline, because closing-off of the feed pipe is disposed upstream of the filter separator presented therein. The sediment is completely separated from the conveyance gas herein, which takes place by means of the aforementioned closing-off of the feed pipe, thereby making it impossible to integrate a configuration of this type in a pipeline for the compressed air conveyance of feedstock.

The invention assumes the objective of creating a separator according to the preamble of claim 1 in such a manner that it can be integrated directly in a pipeline for conveying a feedstock conveyed through the pipeline by means of a pneumatic conveyor.

To attain the assumed objective, the method is characterized by the technical teachings of claim 1. A device is characterized in an independent accessory claim.

The substantial advantage of the technical teachings is that in this case, no regulated or unregulated introduction of the material to be conveyed or discharge of the material to be conveyed or maintenance of pressure (e.g. by means of an airlock in the region of the screen) need be carried out, as has been the case with the prior art. In these cases, the pneumatic conveyance of the bulk material flow is affected in an undesired manner.

With the present invention, there is the resulting advantage that the pipeline screen according to the invention can now be implemented as an integral component for the pneumatic conveyance of a suitable bulk material flow, which until now has not been known.

The invention concerns a pipeline screen, directly incorporated in a pneumatic feed pipe (preferably in a compressed air or vacuum conveyance).

It is constructed in a streamlined manner and has very small dimensions.

It contains no moving parts and eliminates dead zones.

In this case, adaptations specific to bulk material can be easily implemented.

Product changes require no, or very little cleaning effort.

It is a cost-effective variant, as it can be directly incorporated in the feed pipe (horizontally and vertically).

The granulate arrives from the feed pipe in the pipeline screen along the central axis or at a right angle to the central axis (illustrated here with a disperser). The granulate must be well dispersed, distributed over an annular cross-section. Following the dedusting in the annular cross-section the cleansed product flow is collected in a cone and fed back into the feed pipe.

The product flow on the input end contains conveyor gas, granulate and fine elements. The fine elements contain particles, fibers, clusters or dust. The portion of fine elements in the product flow at the output end is dependent on the degree of separation performed by the screen.

The cleansing airflow is provided by means of a compressor. The fine elements are removed from the return gas-flow by means of a separator (e.g. a filter or cyclone). The cleansing airflow arrives at an internal casing sealed off from the product flow, having cleansing openings distributed about the circumference of the walls of the internal casing. The cleansing airflow exits these opening at a specific angle to the product flow (conveyor gas, granulate and fine elements) and aerates the product flow. As a result, the lighter product flow particles (fine particles: particles, fibers, clusters or dust) have a different trajectory than that of the granulate. The change to this trajectory for the lighter product flow particles in relation to the trajectory of the heavier granulate is used for their separation from the material being conveyed.

The dimensions of the cleansing openings, as well as their angle to the conveyance airflow can be individually adjusted according to the product. The direction as well as the cross-section of the openings can be altered. Likewise, nozzle type inserts may be disposed in the cleansing openings.

The cleansing airflow flows through the product flow in an annular cross-section and arrives at the discharge pipe by means of an annular sheath connected, externally in a radial manner at the annular cross-section, in an airtight manner, to the cleansing air. In the aerating of the product flow with cleansing air, fine elements or individual fibers or clusters of fibers are carried off, blown into the radial external annular sheath, collected there, and as filled cleansing air, separated out in a separator. The sluggish granulate cannot be carried away through the diagonally or perpendicular cleansing air blowing through the product flow. It maintains its trajectory to a substantial degree.

Because the pipeline screen is built into a pipeline (with pneumatic conveyance), there is a higher or lower static pressure at this point than in the surrounding environment. As a result, the pipeline screen, the compressor and the separator must be able to function at a higher or lower pressure level (pressure or vacuum conveyance) than that of the ambient pressure.

The pipeline screen differs from counter-flow screens in the following characteristics:

a. It can be directly integrated in the feed pipe at an arbitrary location.
b. The cleansing openings are located in the internal casing (a counter-flow screen functions only with a counter-flow in a cleansing route).
c. The counter-flow screen requires a discharge organ (e.g. an airlock) at the bulk material outlet, in order to discharge the bulk material (granulate) from the higher pressure level in the counter-flow screen. Without a discharge organ, the cleansing air cannot flow against the product flow (the pressure in the bulk material outlet cannot be counteracted).

The subject matter of the invention for the present invention can be derived not only from the subject matter of the individual claims, but also from combinations of individual claims.

All information and characteristics disclosed in the documentation, including the abstract, in particular the spatial design illustrated in the drawings, are claimed as substantial to the invention, insofar as they are novel, individually or in combination, in comparison to the prior art.

In the following, the invention shall be explained in greater detail based on drawings illustrating only one execution method. Herein, further characteristics and advantages substantial to the invention may be derived from the drawings and their description.

They show:

FIG. 1: A schematic illustration of a pipeline screen according to the invention FIG. 2: The overall design with a flow chart of the pipeline screen according to FIG. 1

Figure 2:
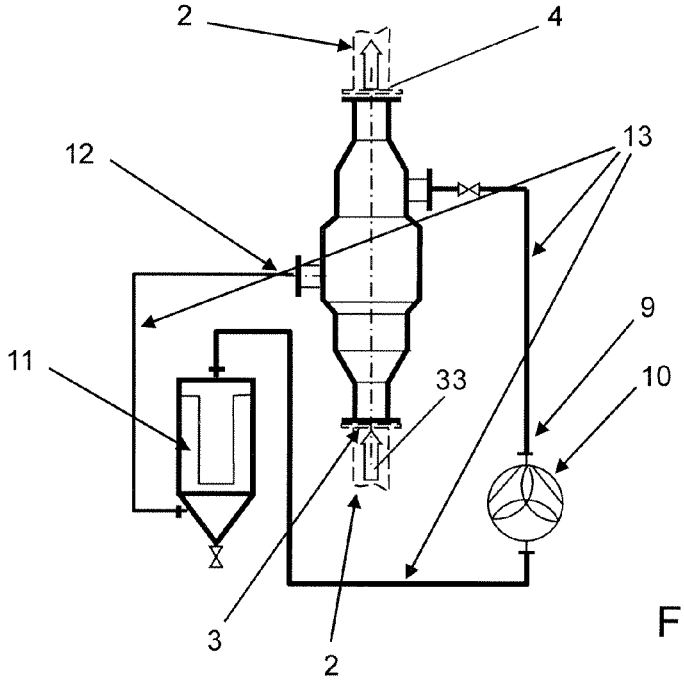
Figure 3:
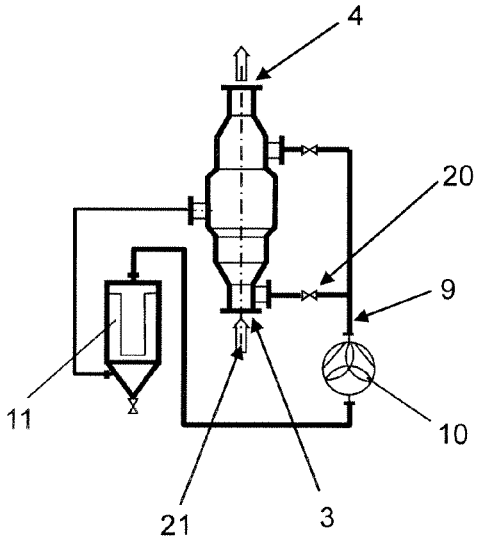

FIG. 3: A variation of the design shown in FIG. 2

Figure 4:
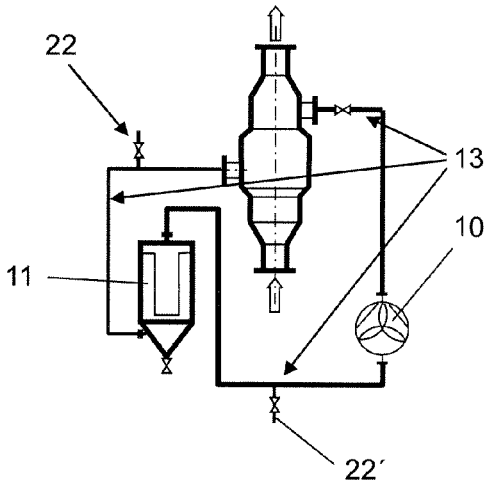

FIG. 4: Another variation regarding the design in comparison to FIG. 2

Figure 5:
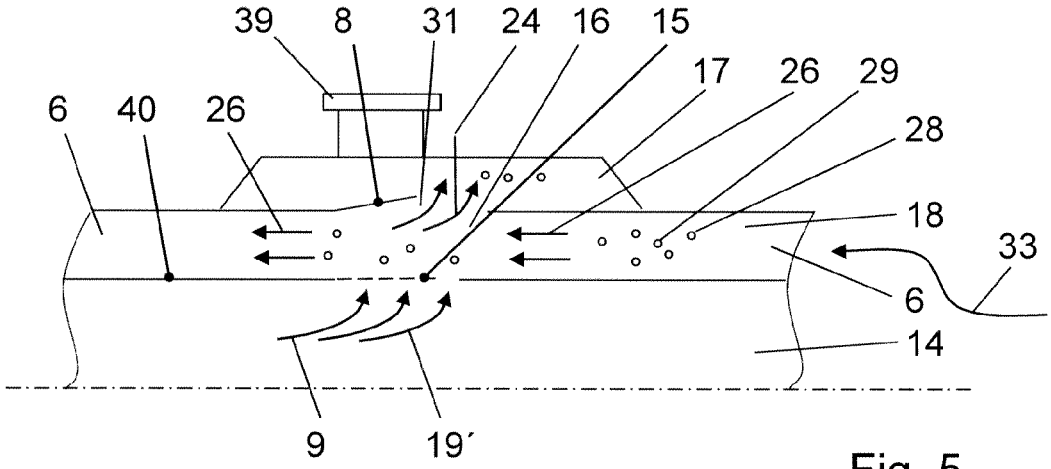

FIG. 5: A schematic illustration of the cleansing path

Figure 6:
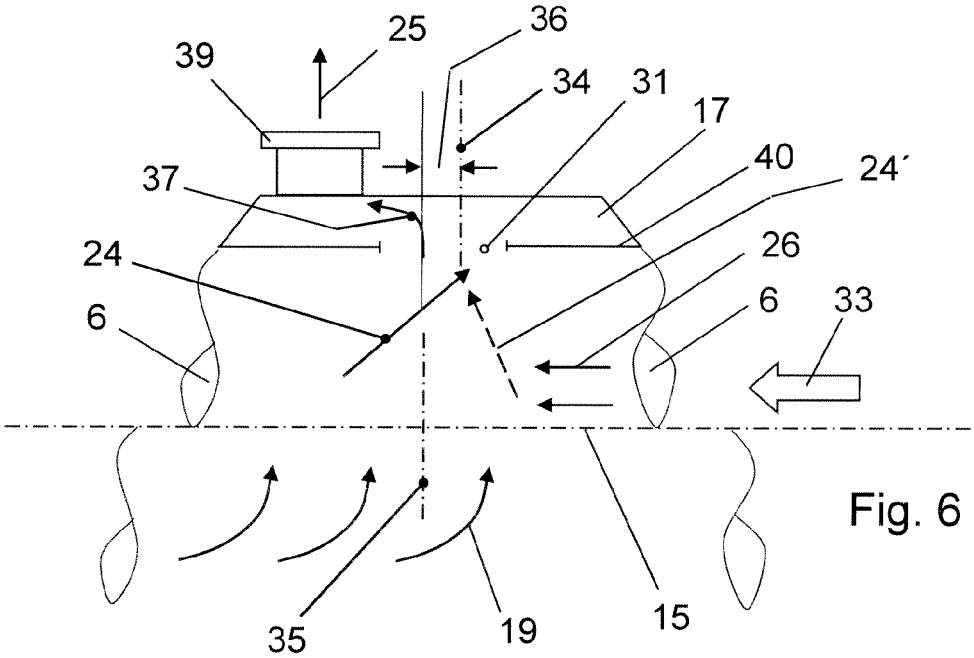

FIG. 6: A further example in comparison to FIG. 5 regarding the direction of the airflow FIG. 7: An illustration of various possibilities for guiding the cleansing airflow FIG. 8: A variation deviating from that in FIG. 1 in that the feedstock is deflected radially outwards at an angle to the longitudinal axis after the cleansing FIG. 9: An illustration like FIG. 1, in which the cleansing air flows from the inside outwards FIG. 10: A variation of FIG. 1, in which the cleansing air flows from the outside inwards.

The pipeline screen 1 is used for the separation of fine elements (fine particles or individual fibers or clusters of fibers or dust) in granulate-like bulk materials from a pipeline, preferably within a pneumatic feed pipe.

It is built into a pipeline 2 directly, preferably within a pneumatic feed pipe (preferably a compressed air or vacuum conveyor).

The pipeline screen 1 can be built into the feed pipe at an arbitrary location.

The pipeline screen 1 does not require a pressure limiter or mass flow regulator (e.g. in the form of a rotary airlock) directly on the product flow input end 3 or product flow output end 4. It may be installed horizontally or vertically.

In the vertical construction, it may be filled with conveyed material from below or from above. There is a pneumatic vacuum or pressure conveyance possible in a feed pipe. The pipeline screen is constructed in a streamline fashion, and has small dimensions.

The product flow 3 arrives from the pipeline 2 at an angle parallel, diagonal or perpendicular to the central axis 5 in the pipeline screen 1. The granulate must be well dispersed, distributed over an annular cross-section 6. The annular cross-section 6 has a larger diameter than the pipeline 2. The increase in the diameter of the annular cross-section 6 compared to the diameter of the pipeline 2 lies between 10-500% of the diameter of the pipeline. Externally, the annular cross-section 6 is formed by the pipe sheath 40 of the pipeline 2 that has been enlarged in diameter, while the internal sheathing surface is formed by the outer circumference of the inner casing 14.

After passing through the annular cross-section 6 and the therein resulting cleansing, the cleansed product flow 4 is collected in a cone 7 of the pipeline screen 1 located downstream of the cleansing plane 16 and returned to the pipeline 2.

The cleansing airflow 9 is provided by means of a compressor 10 (e.g. a ventilator). Dust and granulate are removed from the return gas flow 12 by means of a separator (e.g. a filter or cyclone). This cleansing cycle 13 can function at different pressure levels. The adjustable pressure level depends on the pressure at the location where the pipeline screen 1 is installed.

A closed, and thereby gas-tight internal casing 14, has cleansing openings 15 distributed about its circumference, which penetrate the sheathing of the internal casing 14. The cleansing air 9 introduced to the interior of the internal casing 14 can enter or exit through the cleansing openings 15. The cleansing air 9 can travel in both flow directions (cf. FIGS. 9 and 10). Preferably however, the cleansing air 9 flows out of the internal casing 14 through the cleansing openings 15 into the annular cross-section 6 at the region of the cleansing plane 16, (cf. FIGS. 1 and 7) and meets the axial product flow 18 at an angle. For purposes of clarification, this variation shall be explained in greater detail in the following.

By aerating the product flow 18 with the cleansing air 9 meeting said product flow 18 at an angle, fine particles or individual fibers or clusters of fibers or dust are carried radially outwards and captured in an annular sheath 17 radially encompassing the cleansing openings 15 and separated in a separator 11 connected to said in an airtight mariner. The sluggish granulate cannot be carried off by means of the cleansing air 9, and substantially maintains thereby its axial trajectory (parallel to the longitudinal axis of the internal casing 14).

The internal casing 14 has one or more intakes in the form of an intake nozzle, by means of which the cleansing air 9 can be introduced or discharged.

The dimensions of the internal casing 14 and the cleansing openings 15 can be individually adjusted for each product.

The optimal operation with an acceleration airflow 20 is possible. For this, a portion of the cleansing airflow 9 is diverted and the conveyor air 21 is introduced close to the product input 3. This portion is returned to the cleansing cycle 13. This is illustrated in FIG. 3.

The optimal operation, "partial conveyor air discharge" with the aid of a regulator 22, for example, via the cleansing air cycle 13 is also possible. As a result, the conveyor airflow rate is decreased at the product discharge. This is illustrated in FIG. 4.

FIG. 4 shows, as a further variation, that the regulator 22' can also be disposed at the vacuum end of the compressor.

In accordance with FIGS. 2-4, the compressor 10 is located in the cleansing cycle 13.

The separator 11 shown in FIGS. 2-4 can be designed as a filter or a cyclone.

According to FIG. 1, the functioning principle of the present invention consists of the feedstock 33, conveyed in a pipeline 2 by means of compressed air conveyance, is radially dispersed in the region of the central longitudinal axis 5 of the pipeline screen 1, so that it can be conducted to an internal casing 14 having an enlarged diameter with an external diameter that is larger than the annular cross-section 6.

The radial dispersion of the feedstock 33 takes place by means of a front end cone 38, disposed at the end of the somewhat cylindrical internal casing 14, serving solely for the air conveyance of the feedstock 33, and the sheathing surface of which forms the radial internal boundary of the annular cross-section 6.

The outer boundary of the annular cross-section 6, into which the feedstock 33 to be cleansed is conveyed, is formed by an external sheathing of the pipeline screen 1, designed as an annular sheath 17 with an enlarged diameter. The feedstock 33 flows radially into the annular cross-section 6, wherein typical gas speeds for compressed air conveyance lie within the range of 18-40 meters/second. This speed is dependent on the product.

It is important that a splitting or a radial distribution of the feedstock 33 takes place in the form of an annular bulk product flow, and this by means of flowing about the internal casing 14, the sheathing surface of which has a larger diameter than the diameter of the pipeline 2, in order that the feedstock 33 be evenly conveyed in the form of a product curtain along the internal casing 14.

The invention is not limited to the pipeline 2 being flush with the central longitudinal axis 5 of the pipeline screen 1.

In another embodiment it may also be provided that the product feed 33 is introduced at an angle of, for example, 90°, or at other angles running diagonally to the central longitudinal axis 5.

It is important here that a cleansing airflow of cleansing air 9 aerates the bulk material flow distributed as an annular product curtain at least at an specific angle to the direction of flow of the bulk material flow in order that the lighter product flow elements (fine particles: particles, fibers, clusters or dust) are conveyed radially outwards from the bulk material flow, and to convey said to an annular sheath 17 connected to the pipeline screen 1 in the region external to the annular cross-section 6, which is aerated by the cleansing air 8 at an angle approaching 90°.

The terms "approaching radial" or "approaching perpendicular" for the angle between the cleansing air 9 and the axial direction of conveyance of the feedstock 33 to be cleansed are only to be understood as exemplary, as the preferred implementation. This angle, however, can be altered to some degree. This shall be explained in greater detail below with reference to FIGS. 5 and 6.

Figure 10:
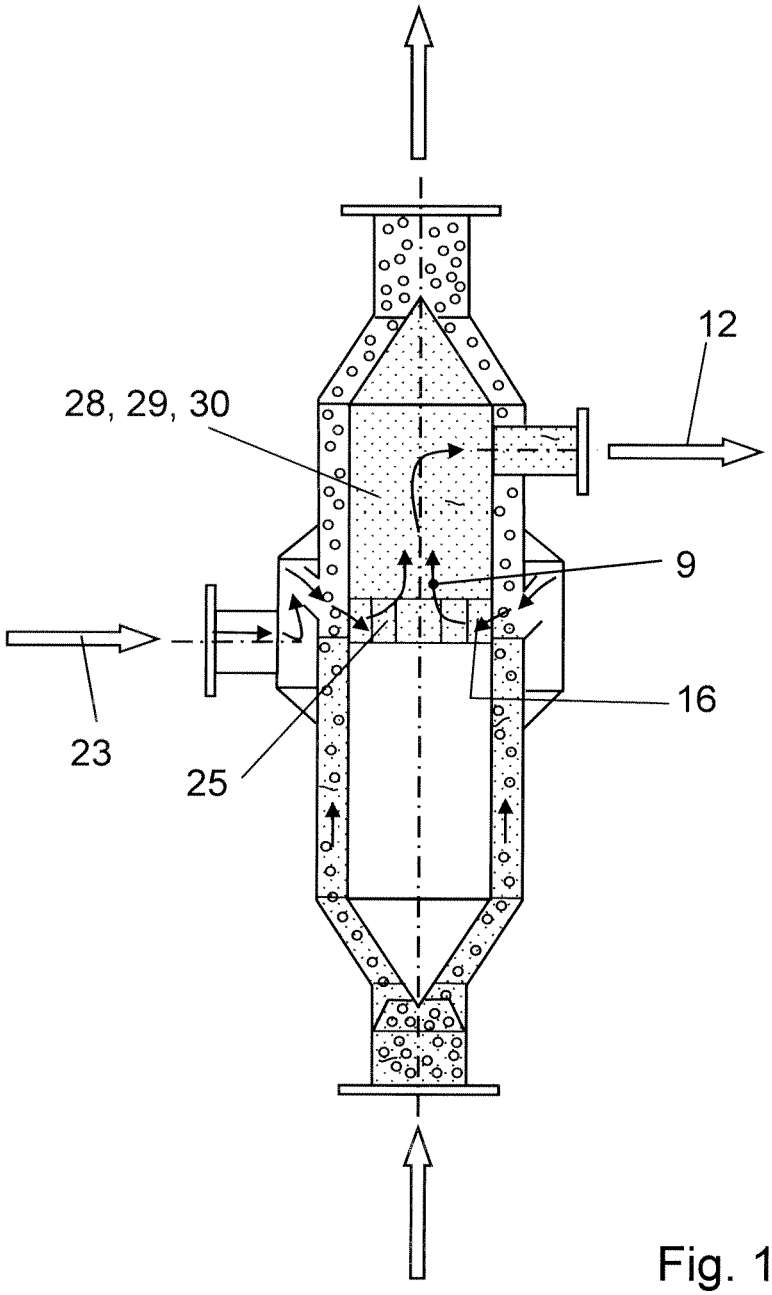

Furthermore, the invention is not limited to the cleansing air flowing from the inside towards the outside in the feedstock to be cleansed, in that FIG. 10 shows the reverse flow direction.

In this design of the invention, it may also be provided that the cleansing air flows from the outside towards the inside in the feedstock, thereby carrying the cleansing airflow on the inside of the pipeline screen, and not external to said, as shall be explained in greater detail in subsequent drawings (FIG. 10).

In the embodiment shown, according to FIG. 1, the radial aeration of the cleansing airflow from the otherwise airtight internal casing 14 through dedicated cleansing openings 15 in the sheathing of the internal casing 14 is illustrated, wherein the cleansing air 9 flows in the direction of the arrow 24 through the annular cross-section 6 receiving the feedstock 33.

The cleansing air 9 flows in a cycle, wherein the cleansing air 9 escapes in the direction of the arrow 37 in the return gas flow 12 of a cleansing cycle 13, and in the direction of the arrow 23 is introduced by means of an intake nozzle on the one side of the pipeline screen 1.

After the cleansing of the feedstock 33 (passing through the cleansing plane 16), the feedstock cleansed in this manner flows as a cleansed product flow 4 via a conically expanded ring fitting 8 on the external circumference of the annular cross-section 6 in the direction of the arrow 26 through the annular cross-section 6 and arrives in the second cone 7, where the product flow 4 cleansed in this manner is then returned to the pipeline 2 by means of a compressed air conveyance. The conically, radially expanding shape of the ring fitting 8 provides an improved "catching"—with less fallout—for the cleansed product flow flowing out through the ring fitting 8.

With this description of the method there is the advantage of the invention that, specifically, pipeline screen 1 is integrated directly in the pipeline 2 intended for compressed air conveyance, without the need for any pipeline end pieces or discharge of the bulk material flow from the pipeline 2.

The invention is not limited to the integration of a pipeline screen 1 in a pipeline subjected to high pressure, but rather, it also relates to a pipeline screen 1 functioning with a vacuum conveyance in the pipeline 2.

In both cases, a compressed air conveyance or vacuum conveyance of the feedstock 33 to be cleansed is provided in the pipeline 2. The duty points for the generation and the guidance of the cleansing air 9 may also be different, in accordance with the FIGS. 2, 3, and 4.

With the implementation of a vacuum conveyance, the pressure in the cleansing cycle is less than that of the atmosphere, in order to enable a generation of cleansing air 9 in the annular cross-section 6 of the pipeline screen 1.

In a further development of the present invention, it is also possible for the cleansing cycle 13 to be open, meaning that it is not designed as a closed cycle, but rather, the cleansing air 9 is blown into the nozzle shown in FIG. 1 in the direction of the arrow 23 and flows freely from the nozzle at the output end as return gas-flow 12 in the direction of the arrow 25, without receiving the return gas-flow 12 at all. In other words, a fee exhaust discharge into the atmosphere may take place.

With the use of an open system of this type for the cleansing cycle 13, it must be ensured that the cleansing airflow is regulated such that the discharged airflow corresponds more or less to the airflow introduced as the cleansing airflow.

Accordingly, the invention relates to a pipeline screen 1, which can be implemented for a vacuum or compressed air conveyance with respect to the pipeline 2.

A cleansing in the pipeline screen 1 is illustrated schematically in FIG. 5.

For this, it is apparent that the feedstock 33 is fed as a product curtain into the annular cross-section 6 at the outer circumference of the internal casing 14 in the direction of the arrow 26, wherein the feedstock 33 consists of granulate 28 and the particles 29 and fibers 30 to be separated mixed therein.

As soon as the feedstock 33 conveyed into the annular cross-section in the direction of the arrow 26 arrives in the region of the cleansing plane 16, the desired separation takes place.

The cleansing air 9 flows in the direction of the arrow 19 into the interior of the internal casing 14 and flows into the annular cross-section 6 in the region of the cleansing openings 15 that penetrate the walls of the internal casing 14.

The size of the cleansing openings 15 and their dimensions determines the rate of the airflow, which blows into the annular cross-section 6 of the pipeline screen through said cleansing openings in the direction of the arrow 19. The size of these cleansing openings 15 and their dimensions can be altered to a certain degree.

The rate of the cleansing airflow 9 and its direction in the cleansing plane 16 can also be adjusted with the design of the cleansing openings 15, as shall be explained later with reference to FIGS. 6 and 7.

The annular cross-section 6 is interrupted over 360° by the cleansing openings 15 extending over the entire external circumference on the external circumference of the internal casing 14, thereby forming the cleansing plane 15 located therein. The cleansing openings are therefore designed as open annular cross-sections. It is understood that braces and other bridging means for the axial bridging of the open annular cross-section are present, in order to prevent a complete detachment of the sheathing surface of the internal casing 14.

In another design of the present invention, it is also possible that cleansing openings 15 may be disposed as, for example, perforations or slits in the sheathing surface of the internal casing 14, distributed evenly on the external circumference of the internal casing 14.

For this they do not need to form a continuous annular opening, interrupted only by braces, but may also be provided as cleansing openings 15 distributed evenly over the circumference at regular intervals.

The shape of the cleansing openings can be slit-like, cylindrical, or any other arbitrary shape.

Likewise, discharge panels may be implemented, which provide for a specific orientation of the cleansing air 9 in the annular cross-section 6.

Similarly, the discharge openings can be designed as nozzle openings, in order to enable an increase to the flow rate of the cleansing air 9 flowing out of said nozzle openings.

In the embodiment according to FIG. 5, the cleansing air 9 aerates the bulk material flow (feedstock 33) to be cleansed at a slight angle in the direction of the arrow 24, and carries thereby the particles 29 and fibers 30 to be separated out in the direction of the arrow 24 through a dedicated separation opening 31 in the outer circumference of the pipeline screen 1. The cleansing air 9 flows by way of the separation opening 31 into an annular cross-section 17, located on the outer circumference of the pipeline screen 1 more or less opposite the separation opening 31, and which is integrated in an airtight manner in the cleansing cycle 13.

The bulk material flow cleansed in this manner continues to flow in the direction of the arrow 26 in the annular cross-section 6, is then captured in the opening of a conically expanding ring fitting 8 and continues to flow in the annular cross-section 6 along the outer circumference of the internal casing 14. Beyond the cone 38', the annular cross-section realigns itself centrally to the pipeline 2 such that the cleansed product flow 4 flows out at this point in the pipeline 2.

FIG. 6 illustrates various possibilities for the guidance of the airflow of the cleansing airflow from the inner surface of the internal casing 14 through the cleansing openings 15.

The cleansing airflow flows herein in the direction of the arrow 19 from the inner surface of the internal casing 14 through the cleansing openings 15, and depending on the guidance of the cleansing airflow, it is either directed at an angle against the inflowing product flow 8 in the direction of the arrow 24, for example, or it can be guided in other angular directions, as is indicated by the direction of the arrow 24'.

The position—aligned or unaligned—of the separation opening 31 in relation to the position of the plane of the cleansing openings 15 is also a factor in the guidance of the cleansing airflow in the annular cross-section 6 for the formation of the cleansing plane 15.

In FIG. 6 it is shown that it is not necessary with regard to the solution, that the central axis 34 of the separation opening 31 must be aligned with the central axis 35 of the cleansing openings 15. They may be offset to one another in this case. The offsetting can be a displacement to the left or right.

FIG. 6 shows an offset 36 displaced to the left. The left oriented offset means that the offset is located upstream of the bulk material flow. It can, however, be directed downstream.

These directions also determine the direction of the outflowing cleansing airflow, which flows outwards from the discharge nozzles 39 in the example of FIG. 6 in the direction of the arrow 37.

Figure 7:
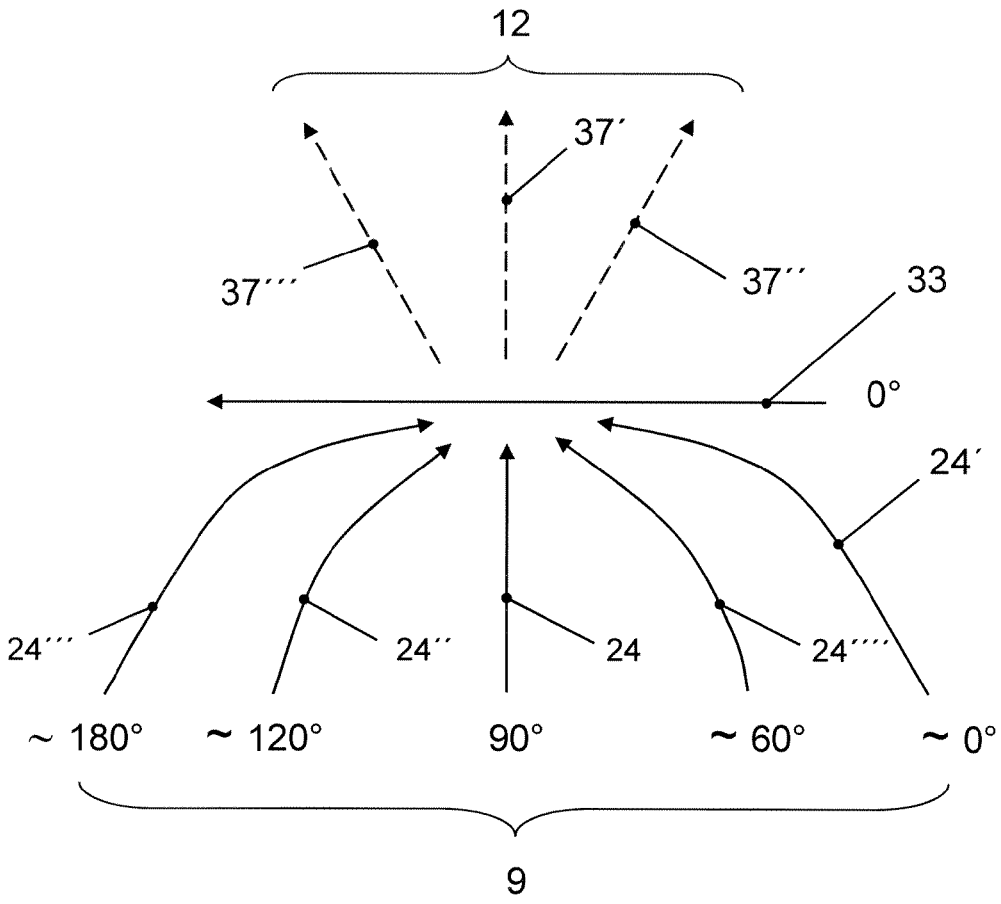

FIG. 7 shows various possibilities for the guidance of the cleansing airflow, where various possible angle settings are illustrated.

In a preferred design, the cleansing airflow flows into the annular cross-section 6 through the cleansing openings in a radial direction (90°) along the direction of the arrow 24, and intersects the bulk material flow (feedstock 33) to be cleansed at a more or less perpendicular orientation.

The invention is not limited to this. The invention shows that the cleansing air 9 can also be oriented in the direction of the arrows 24', 24", 24'", and 24"". This results in angles ranging from 0°-180°, as is schematically represented in FIG. 7.

This inflow into the feedstock 33, conveyed along the annular cross-section 6 at a given angle of 0° affects the outflow of the cleansing airflow as well, which contains the particles 29 and fibers 30 which are to be removed. Various arrow directions 37', 37" and 37'" are shown here, in which the cleansing airflow, which now carries the fine elements, flows out as return gas-flow 12.

Figure 8:
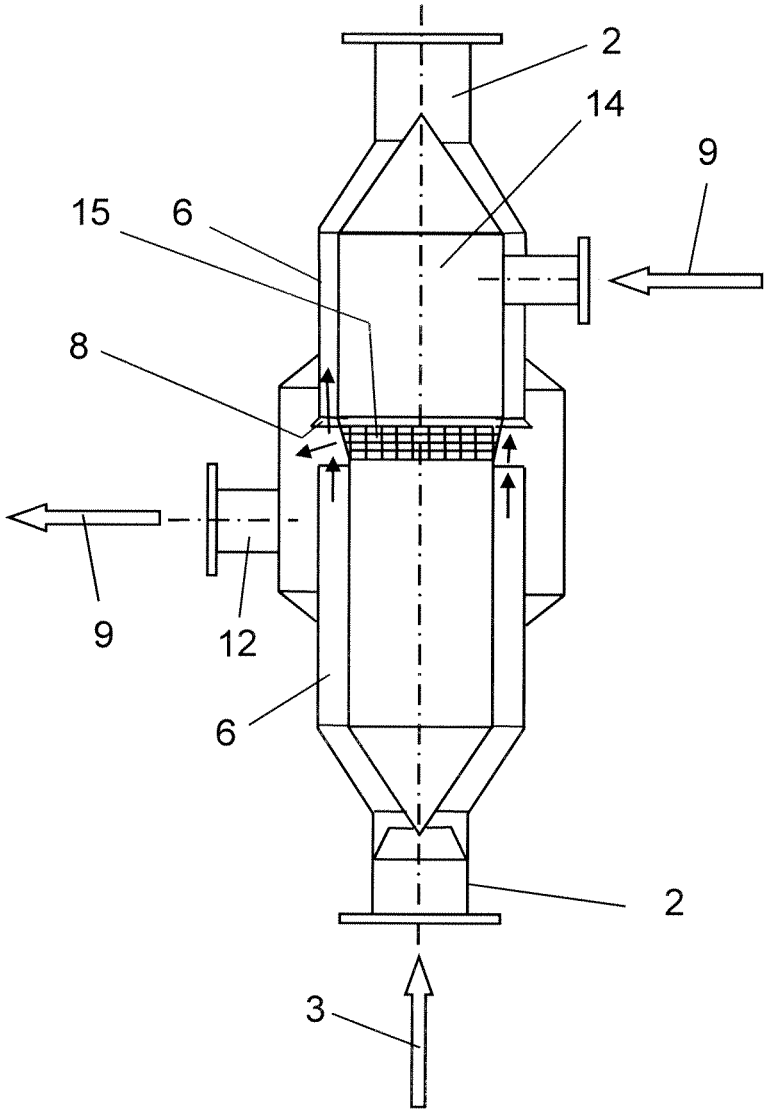

FIG. 8 shows, as a further embodiment, cleansing openings 15 expanding conically in the direction of flow of the product flow 3. The internal casing 14, in relation to the cleansing openings distributed over the circumference of the internal casing 14, is split into two parts. It forms a first cylindrical hollow body upstream of the cleansing openings 15 having a smaller diameter than, in comparison, the second part of the internal casing, which transitions downstream of the cleansing openings 15 to a larger diameter. In this manner, the ring fitting 8 receiving the cleansed product flow 4 has an expanded diameter compared to a ring fitting according to FIG. 1. As a result, a lower degree of fallout is obtained in the product flow 3 to be cleansed, because a flow of the product flow 18 is obtained at an angle to the longitudinal axis of the annular cross-section 6. In other words, there is a radially outwards offset collection path for the cleansed product flow 18.

It should be ensured, however, that the flow rate in the annular cross-section 6 upstream of the cleansing openings 15 corresponds more or less to the flow rate in the annular cross-section 6 downstream of the conically outward expanding cleansing openings.

Figure 9:
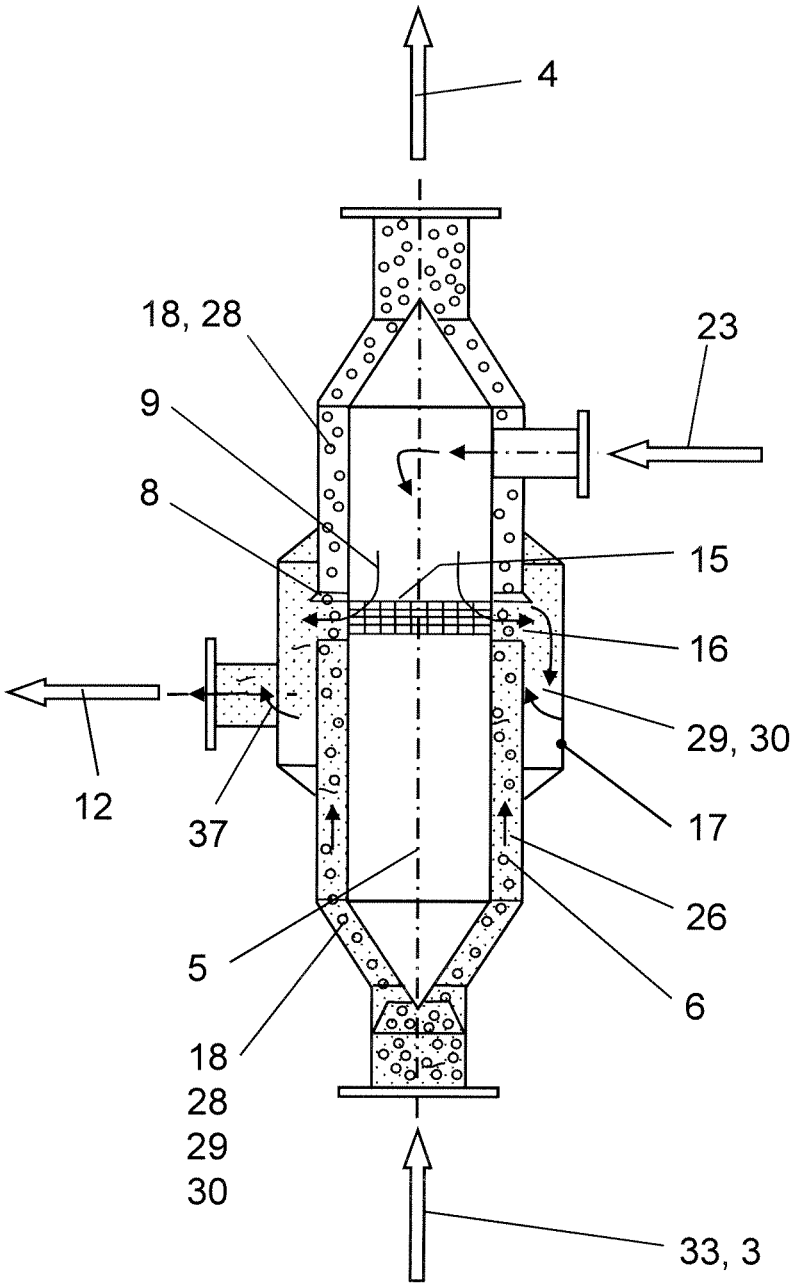

FIG. 9 shows the construction of the pipeline screen 1 corresponding to FIG. 1, wherein the various flow directions are indicated to clarify the function.

FIG. 10 shows the kinetic reversal of the guidance of the cleansing airflow of the cleansing air 9 in comparison with FIGS. 1 and 9. In FIG. 10, the guidance of the cleansing airflow is carried out from radially outwards to radially inwards. The cleansing plane 16 is thereby displaced to the interior of the internal casing 14.

The method according to the invention is distinguished, therefore, in that the product flow 3 is radially dispersed at the input end of an airtight pipe screen 1 integrated in the pipeline into an annular cross-section 6, and aerated there in the region of a cleansing plane 16 by a cleansing airflow 9 flowing at an angle to the dispersed product flow 3, which deflects lighter particles, fibers, clusters, dust or similar items, carried in the product flow 3 from the trajectory of the heavier granulate, and conveyed in an annular sheath 17 through which the cleansing air 9 flows, from which they are removed by means of a separator 11 or a cyclone.

A first embodiment provides that the cleansing airflow 9 aerates the product flow 3 at an angle oriented from radially inwards towards radially outwards, thereby deflecting the lighter elements from their trajectory to a radially outward lying annular sheath 17, through which the cleansing air flows.

In the second embodiment it is provided that the cleansing airflow 9 aerates the product flow 3 at an angle oriented from radially outwards towards radially inwards, thereby deflecting the lighter elements from their trajectory to a radially inward lying annular sheath 17, through which the cleansing air flows.

| Reference Symbol Legend | |
|---|---|
| 1 | Pipeline screen |
| 2 | Pipeline |
| 3 | Product flow - intake end |
| 4 | Product flow - output end |
| 5 | Central longitudinal axis |
| 6 | Annular cross-section |
| 7 | Cone |
| 8 | Ring fitting |
| 9 | Cleansing air |
| 10 | Air compressor |

-continued

| Reference Symbol Legend | |
|---|---|
| 11 | Separator |
| 12 | Return gas-flow |
| 13 | Cleansing cycle |
| 14 | Internal casing |
| 15 | Cleansing opening |
| 16 | Cleansing plane |
| 17 | Annular sheath |
| 18 | Product flow |
| 19 | Direction of the arrow |
| 20 | Acceleration airflow |
| 21 | Conveyor air |
| 22 | Regulator |
| 23 | Direction of the arrow |
| 24 | Direction of the arrow 24' |
| 25 | Direction of the arrow |
| 26 | Direction of the arrow |
| 27 | Direction of the arrow |
| 28 | Granulate |
| 29 | Particle |
| 30 | Fiber |
| 31 | Separation opening |
| 32 | — |
| 33 | Feedstock |
| 34 | Central axis (of 31) |
| 35 | Central axis (of 15) |
| 36 | Offset |
| 37 | Direction of the arrow |
| 38 | Cone 38' |
| 39 | Discharge nozzle |
| 40 | Pipe sheath |

The invention claimed is:

1. A method for separating fine particles from granulate bulk materials that are conveyed in a direction as a product flow by one of a compressed air and a vacuum conveyance in a pipeline, comprising the steps of:

radially dispersing the product flow at an intake end of a pipe screen integrated in an airtight manner in the pipeline, into an annular cross-section;

aerating the product flow in the annular cross-section by a cleansing airflow flowing in the region of a cleansing plane at an angle to the direction of the product flowing the annular cross-section, said aerating step deflecting deflected material comprising any of lighter particles, fibers, clusters, and dust carried in the product flow from the trajectory of the heavier granulate bulk materials, and conveying said deflected material into an annular sheath connected to the annular cross-section, the cleansing airflow flowing through the annular sheath; and removing said deflected material from the annular sheath with a separator.

2. The method according to claim 1, wherein said aerating step comprises the step of conducting the cleansing airflow in a closed cycle through the pipe screen.

3. The method according to claim 2, further comprising the steps of:

forming an acceleration airflow in the cleansing zone, by diverting a portion of the cleansing airflow; and introducing the conveyor air at the product intake.

4. The method according to claim 2, further comprising the step of effecting a partial conveyor air discharge with the support of a regulator on a cleansing air cycle wherein the conveyor airflow rate is reduced at the product output.

5. The method according to claim 1, wherein said aerating step comprises the step of conducting the cleansing airflow in an open flow path through the pipe screen.

6. The method according to claim 5, further comprising the steps of:

forming an acceleration airflow in the cleansing zone, by diverting a portion of the cleansing airflow; and introducing the conveyor air at the product intake.

7. The method according to claim 5, further comprising the step of effecting a partial conveyor air discharge with the support of a regulator on a cleansing air cycle wherein the conveyor airflow rate is reduced at the product output.

8. The method according to claim 1, further comprising the steps of:

forming an acceleration airflow in the cleansing zone, by diverting a portion of the cleansing airflow; and introducing the conveyor air at the product intake.

9. The method according to claim 1, further comprising the step of effecting a partial conveyor air discharge with the support of a regulator on a cleansing air cycle wherein the conveyor airflow rate is reduced at the product output.

10. The method according to claim 1, wherein said separator comprises a cyclone.

11. A pipeline screen for the separation of fine particles from granulate bulk materials conveyed in a product flow by one of compressed air and a vacuum conveyance in a pipeline, wherein the pipeline screen is disposed in an airtight manner in a pipeline, the pipeline screen comprising a double sheath, said double sheath forming an annular gap extending axially, through which the product flow to be cleansed is conveyed, the annular gap having a diameter larger than a diameter of the pipeline, the annular gap interrupted by a cleansing plane extending radially over the circumference of the annular gap, through which a cleansing air from an air source is blown into the product flow at an angle to the direction of conveyance of the product flow, and an annular sheath disposed radially outwards of the cleansing plane and encompassing the annular gap, which receives the cleansing air and feeds said cleansing air to a separator or cyclone.

12. The pipeline screen according to claim 11, wherein the annular gap is formed radially inwards by a sheathing surface of an internal casing having a plurality of cleansing openings distributed on a circumference of the sheathing surface of the internal casing, the plurality of cleaning openings penetrating the sheathing surface of the internal casing and through which the cleansing air can be introduced into the product flow at an angle to the product flow.

13. The pipeline screen according to claim 12, wherein the annular gap conveying the product flow is radially offset downstream of the cleansing openings.

14. The pipeline screen according to claim 12, wherein a radial dispersion of the product flow is obtained through a cone disposed on an end of an internal casing, which forms the annular cross-section with a parallel cone of the pipeline.

15. The pipeline screen according to claim 12, further comprising a second cone downstream of the cleansing plane in the product flow, wherein, the product flow passes the second cone and is thereafter returned to the pipeline.

16. The pipeline screen according to claim 12, wherein the cleansing air entering radially inwards can encounter a deflector to be deflected radially outwards into the product flow to be cleansed.

17. The pipeline screen according to claim 11, wherein a radial dispersion of the product flow is obtained through a cone disposed on an end of an internal casing, which forms the annular cross-section with a parallel cone of the pipeline.

18. The pipeline screen according to claim 17, further comprising a second cone downstream of the cleansing plane in the product flow, wherein, the product flow passes the second cone and is thereafter returned to the pipeline.

19. The pipeline screen according to claim 11, further comprising a second cone downstream of the cleansing plane in the product flow, wherein, the product flow passes the second cone and is thereafter returned to the pipeline.

20. The pipeline screen according to claim 11, wherein the cleansing air entering radially inwards can encounter a deflector to be deflected radially outwards into the product flow to be cleansed.

21. The pipeline screen according to claim 11, wherein the cleansing air arriving from radially outwards can encounter a deflector to be deflected radially inwards into the product flow to be cleaned.

* * * * *